US007828425B2

(12) United States Patent
Kang et al.

(10) Patent No.: US 7,828,425 B2
(45) Date of Patent: Nov. 9, 2010

(54) INK CIRCULATION SYSTEM, INKJET RECORDING APPARATUS, AND INK CIRCULATION METHOD THEREOF

(75) Inventors: Sung-wook Kang, Seoul (KR); Kazuo Haida, Seongnam-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 860 days.

(21) Appl. No.: 11/696,861

(22) Filed: Apr. 5, 2007

(65) Prior Publication Data

US 2008/0079791 A1 Apr. 3, 2008

(30) Foreign Application Priority Data

Sep. 29, 2006 (KR) ..... 2006-96173

(51) Int. Cl.
*B41J 2/175* (2006.01)
*B41J 2/19* (2006.01)
*B41J 2/18* (2006.01)

(52) U.S. Cl. ..... 347/93; 347/5; 347/6; 347/20; 347/84; 347/85; 347/86; 347/89; 347/92

(58) Field of Classification Search ..... 347/89, 347/92, 93
See application file for complete search history.

(56) References Cited

U.S. PATENT DOCUMENTS 6,116,727 A * 9/2000 Hagiwara ..... 347/89
7,585,063 B2 * 9/2009 Okuda ..... 347/86
2004/0085416 A1 5/2004 Kent

FOREIGN PATENT DOCUMENTS

JP 2006122814 5/2006

OTHER PUBLICATIONS

CN Office Action issued Apr. 6, 2010 in CN Application No. 200710137354.0.

* cited by examiner

*Primary Examiner*—Ryan Lepisto
(74) *Attorney, Agent, or Firm*—Stanzione & Kim LLP

(57) ABSTRACT

An ink circulation system, an inkjet recording apparatus having the ink circulation system, and an ink circulating method thereof. The ink circulation system includes an ink tank including an ink outlet and an ink inlet, a head assembly including a head chip through which an ink is discharged, and a filter, a supply path which supplies the ink of the ink tank to the head assembly, a first feed line through which ink of the head assembly at the upstream of the filter is conveyed into the ink tank, a second feed line through which the ink of the head assembly at the downstream of the filter is conveyed to the ink tank, and a pump which is provided at the ink inlet of the ink tank to provide the first and the second feed lines with a negative pressure to circulate the ink.

28 Claims, 5 Drawing Sheets

INK CIRCULATION SYSTEM, INKJET RECORDING APPARATUS, AND INK CIRCULATION METHOD THEREOF

CROSS-REFERENCE TO RELATED APPLICATIONS

This application claims priority under 35 U.S.C. §119(a) from Korean Patent Application No. 10-2006-096173, filed Sep. 29, 2006, in the Korean Intellectual Property Office, the entire disclosure of which is incorporated herein in its entirety by reference.

BACKGROUND OF THE INVENTION

1. Field of the Invention

The present general inventive concept relates to an ink circulation system and an inkjet recording apparatus. More particularly, the present inventive concept relates to an ink circulation system to perform ink circulation between an ink head, which discharges ink to form an image onto a recording medium, and an ink tank, and an inkjet recording apparatus using the same.

2. Description of the Related Art

An image forming apparatus such as an inkjet printer fires droplets of printing ink onto a printing medium such as a paper sheet or fabric to form an image in a desired color.

A conventional inkjet printer generally includes an ink circulation system which allows the ink to circulate between an ink tank and an ink firing head assembly. FIG. 1 illustrates a general ink circulation system. Referring to FIG. 1, an ink tank 10 (i.e., an ink cartridge) stores printing ink therein, and is connected to a pressure adjusting unit 11. The pressure adjusting unit 11 is connected to a head assembly 12 which fires an ink onto a printing medium to form an image. A pump 14 is provided on an ink circulation path 13 between the head assembly 12 and the ink tank 10.

In the above construction, the pump 14 is driven and negative pressure is generated from the ink tank 10. According to the negative pressure being produced at the ink circulation path 13, ink of the pressure adjusting unit 11 is introduced into the head assembly 12. The pressure adjusting unit 11 usually includes a filter which filters out impurities or bubbles of the fed ink. The ink from the pump 14 is recovered into the ink tank 10. In the meantime, by the negative pressure, the bubbles at the head assembly 12 are moved to the pressure adjusting unit 11 and recovered into the ink tank 10. The negative pressure is exerted by the pressure adjusting unit 11 in the standby mode, such that the ink does not gravitate through a head chip 12*a* of the head assembly 12.

In the general ink circulation system as explained above, due to a resistance of the filter housed inside the pressure adjusting unit 11, it is difficult to recover the bubbles of the head assembly 12 back to the ink tank 10, which causes inefficient ink circulation. As a result, an amount of ink charged in the head assembly 12 is unsatisfactory, thereby causing inefficient ink firing and image quality degradation.

Also the ink circulation system as illustrated in FIG. 1 is not capable of purging, which removes bubbles not only from the head assembly 12, but also from the nozzles of the head chip 12*a*.

SUMMARY OF THE INVENTION

The present general inventive concept provides an ink circulation system, an inkjet recording apparatus and an ink circulation method, which provide smooth ink circulation between a head assembly and an ink tank, and are capable of removing bubbles efficiently.

The present general inventive concept additionally provides an ink circulation system, an inkjet recording apparatus and an ink circulation method, to prime a head chip with ink after removing bubbles from the head assembly.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing an ink circulation system, including an ink tank including an ink outlet and an ink inlet, a head assembly including a head chip through which an ink is discharged, and a filter, a supply path to supply the ink of the ink tank to the head assembly, a first feed line through which ink of the head assembly at the upstream of the filter is conveyed into the ink tank, a second feed line through which the ink of the head assembly at the downstream of the filter is conveyed to the ink tank, and a pump which is provided at the ink inlet of the ink tank, and which provides the first and the second feed lines with a negative pressure to circulate the ink.

The head assembly may include a first reservoir which comprises an ink inlet and a first ink outlet, and a second reservoir which is partitioned from the first reservoir by the filter, and comprises a second ink outlet.

The head chip may be connected to the second reservoir such that the ink of the second reservoir is fired through the head chip.

The second reservoir may be arranged at a lower portion of the first reservoir.

The first reservoir may include an ink guider which guides the ink in a manner such that a distance of ink conveyance between the ink inlet and the first ink outlet is extended.

A valve unit may be further provided, which selectively transmits a pumping force of the pump to the first and the second feed lines.

The valve unit may include 2-way valves connected to the first and the second feed lines, respectively, and accordingly to the pump.

A sub filter may be installed on the second feed line, and the sub filter may have a lower resistance than the filter inside the head assembly.

The pump may include a uni-directional rotational pump which generates a negative pressure to the first and the second feed lines.

The pump may include a bi-directional rotational pump to selectively provide the second feed line with the negative pressure or a positive pressure according to the direction in which the pump is driven.

The supply path may connect the ink outlet of the ink tank to the ink inlet of the first reservoir.

The first feed line may connect the first ink outlet to the pump.

The second feed line may connect the second ink outlet to the pump.

The foregoing and/or other aspects and utilities of the present general inventive concept may also be achieved by providing an inkjet recording apparatus, including a main body, an ink circulation system including an ink tank including an ink outlet and an ink inlet, a head assembly including a head chip through which an ink is discharged, and a filter, a supply path to supply the ink of the ink tank to the head assembly, a first feed line through which ink of the head assembly at the upstream of the filter is conveyed into the ink tank, a second feed line through which the ink of the head assembly at the downstream of the filter is conveyed to the ink tank, and a pump which is provided at the ink inlet of the ink tank, and which provides the first and the second feed lines with a negative pressure to circulate the ink, and a control unit to selectively control the pump such that the ink is forcibly circulated through the first or the second feed line.

A valve unit may be further installed between the first feed line and the pump and between the second feed line and the pump, respectively, to be selectively opened or closed and thus to open one of the first and the second feed line according to the control of the control unit.

The valve unit may include 2-way valves connected to the first and the second feed lines and the pump.

The foregoing and/or other aspects and utilities of the present general inventive concept may also be achieved by providing an ink circulating method, including providing a first circulation in which an ink is circulated between a head assembly housing a filter therein, and an ink tank, the ink being circulated at the upstream of the filter, and providing a second circulation in which bubbles are removed from the downstream of the filter by circulating the ink between the head assembly and the ink tank.

The first circulation may include generating a negative pressure to a first feed line which connects the ink tank and the upstream of the filter of the head assembly, supplying the ink of the ink tank to the head assembly by the negative pressure, and moving the ink of the head assembly from the upstream of the filter to the ink tank by the negative pressure.

The generating of the negative pressure may include rotating a rotational pump which is provided on the first feed line, while the first feed line is open.

The second circulation may include generating a negative pressure to a second feed line which connects the downstream of the filter of the head assembly to the ink tank, supplying the ink of the ink tank to the head assembly by the negative pressure, moving the ink of the head assembly at the upstream of the filter to the downstream by the negative pressure, and recovering a fluid via the second feed line, the fluid including the ink and the bubble at the downstream of the filter.

The generating of negative pressure to the second feed line may include blocking the first feed line and opening the second feed line, and generating a negative pressure by driving a pump which is connected between the first and the second feed lines.

The generating of the negative pressure to the first feed line may include blocking the second feed line and opening the first feed line, and generating a negative pressure by driving a pump which is connected between the first and the second feed lines.

The second circulation may further include filtering the ink being recovered via the second feed line.

Conducting a purging may be further provided, in which the ink of the ink tank is supplied to the downstream of the filter such that the ink is charged in the head chip.

The conducting the purging may include blocking a first feed line which connects the upstream of the filter to the ink tank, opening a second feed line which connects the downstream of the filter to the ink tank, and generating a positive pressure to the second feed line such that the ink of the ink tank is fed to the downstream of the filter and fired through nozzles of the head chip.

The generating of the positive pressure may include rotating a rotational pump installed on the second feed line in opposite direction where the positive pressure is generated.

The foregoing and/or other aspects and utilities of the present general inventive concept may also be achieved by providing an ink circulation system, including a head assembly having a filter, an ink tank to supply ink to the head assembly, and a control unit to provide a first circulation in which an ink is circulated between the head assembly, and the ink tank, the ink being circulated at an upstream of the filter, and a second circulation in which bubbles are removed from a downstream of the filter by circulating the ink between the head assembly and the ink tank.

The head assembly may be divided by the filter into a first reservoir and a second reservoir, and the control unit may control the ink to circulate between the first reservoir and the ink tank in the first circulation and between the second reservoir and the ink tank in the second circulation.

The foregoing and/or other aspects and utilities of the present general inventive concept may also be achieved by providing an ink circulation system, including a head assembly having a filter to partition an inside space into a first reservoir and a second reservoir, an ink inlet to supply ink to the first reservoir, a first ink outlet to discharge the ink from the first reservoir, an ink guider disposed in the first reservoir between the ink inlet and the first ink outlet, a second ink outlet disposed in the second reservoir to supply and discharge the ink to and from the second reservoir, and a head chip disposed opposite on the head assembly to the filter with respect to the second reservoir to eject the ink.

The ink circulation system may further include an ink tank having an ink outlet to be connected to the ink inlet of the head assembly, and an ink inlet to be connected to one of the first ink inlet of the first reservoir and the second inlet of the second reservoir, The ink circulation system may further include a pump to selectively generate a negative pressure and a positive pressure, and a valve to connect the pump to one of the first ink outlet and the second ink outlet to selectively apply the negative pressure and the positive pressure to one of the first ink outlet and the second ink outlet.

The ink circulation system may further include a control unit to control the pump and the valve to selectively provide the negative pressure to at least one of the first ink outlet to selectively provide the positive pressure to the second ink outlet.

The ink circulation system may further include an ink tank connectable to the head assembly to supply ink to the head assembly and receive the ink from the head assembly, and a valve disposed between the head assembly and the ink tank to provide a first circulation mode in which the ink is circulated between the head assembly and the ink tank, the ink being circulated at an upstream of the filter, a second circulation mode in which bubbles are removed from a downstream of the filter by circulating the ink between the head assembly and the ink tank, and a third circulation mode in which the bubbles at a plurality of nozzles are also removed, and the head chip is charged with the ink.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
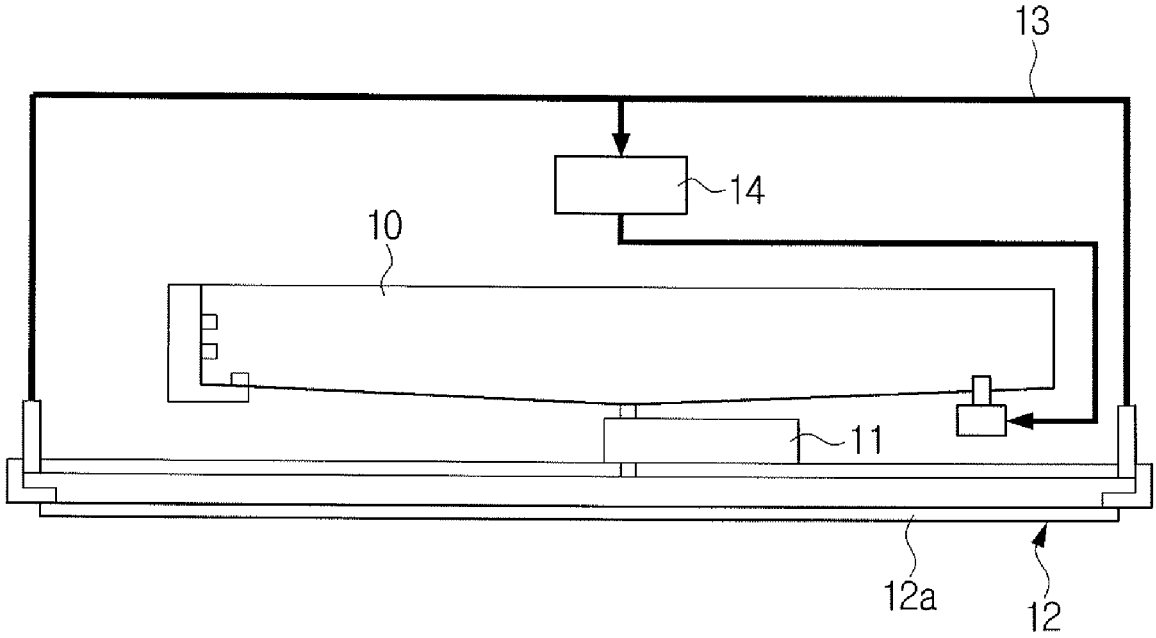
FIG. 1 (PRIOR ART)
FIG. 1 illustrates a conventional ink circulation system.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
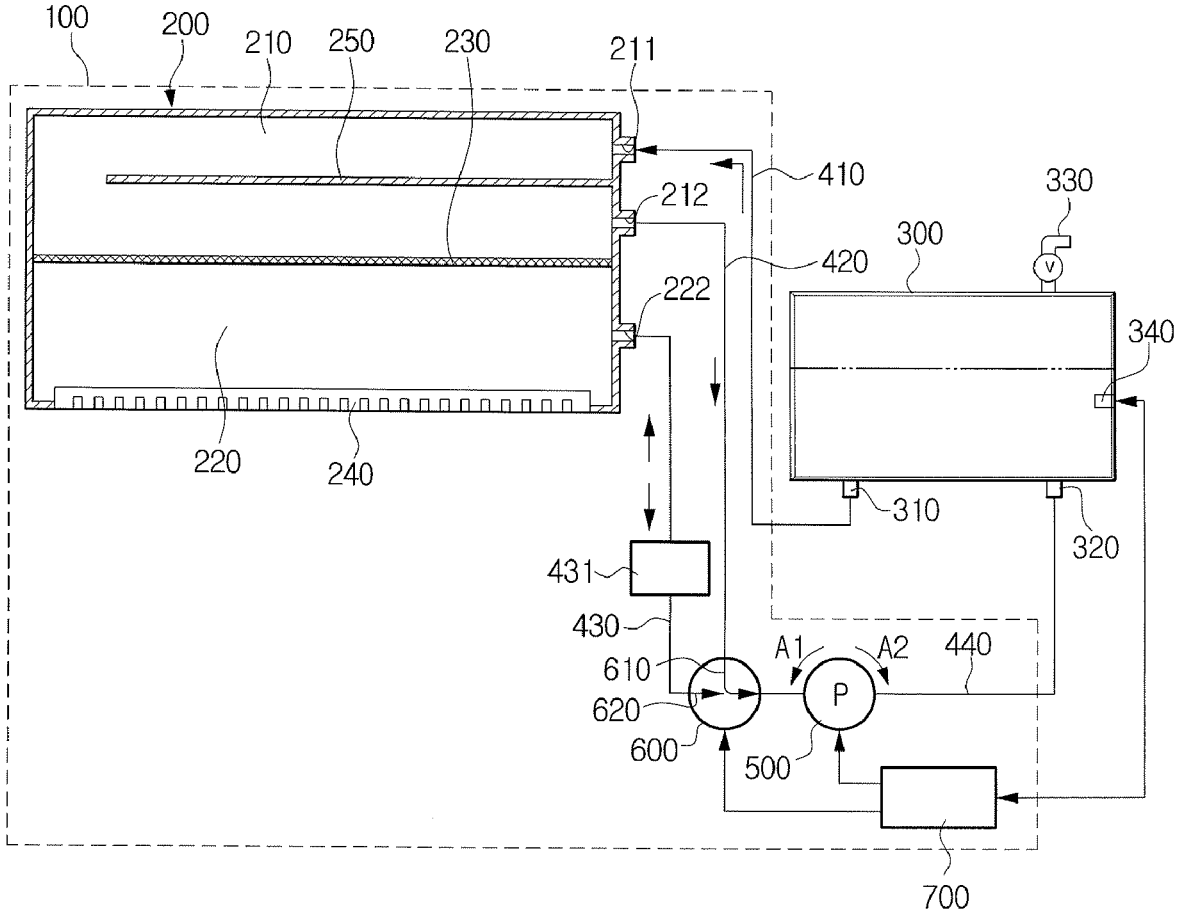
FIG. 2 illustrates an inkjet recording apparatus having an ink circulation system according to an embodiment of the present general inventive concept.

Referring to FIG. 2, an inkjet recording apparatus according to an exemplary embodiment of the present general inventive concept may include a main body 100, an ink circulation system, and a controlling unit 700.

The ink circulation system may include a head assembly 200, an ink tank 300, an ink supply path 410, a first feed line 420, a second feed line 430, a pump 500 and a valve unit 600.

The head assembly 200 may include a first reservoir 210 and a second reservoir 220 which each hold charged ink, a filter 230 to partition the first reservoir 210 and the second reservoir 220, and a head chip 240 having nozzles through which ink is fired.

The first reservoir 210 may include an ink inlet 211 and a first ink outlet 212. The ink inlet 211 may be connected to the ink tank 300 via the ink supply path 410, and ink is introduced through the ink inlet 211. The first ink outlet 212 may be provided downstream of the ink inlet 211 and upstream of the filter 230. The first ink outlet 212 may be connected to the first feed line 420.

The first reservoir 210 may additionally include an ink guider 250 to guide the ink being introduced through the ink inlet 211 to circulate around the first reservoir 210 and head toward the first ink outlet 212. The ink guider 250 may be disposed across the first reservoir 210 such that the ink being introduced through the ink inlet 211 circulates around the first reservoir 210 and moves toward the first ink outlet 212. More specifically, the ink guider 250 may increase the distance of ink flow and guide the ink to spread the interior of the first reservoir 210 thoroughly. The ink guider 250 may be extended from a wall on which at least one of the ink inlet 211 and the first ink outlet 212 is disposed toward an opposite wall disposed opposite to the wall with respect to the first reservoir 210.

The second reservoir 220 may be a space provided downstream of the first reservoir 210, that is, downstream of the filter 230. The second reservoir 220 may be provided lower than the first reservoir 210. The first reservoir 210 and the second reservoir 220 may desirably have the same space. The second reservoir 220 may include a second ink outlet 222. The second ink outlet 222 may be provided downstream of the filter 230, and may be connected to the second feed line 430.

The second reservoir 220 may house the head chip 240 in a fluid connection. The head chip 240 may be exposed to outside of the head assembly 200, and may include nozzles through which ink is fired. Accordingly, an image is formed on a recording medium by the ink fired through the nozzles.

The filter 230 may be interposed between the first reservoir 210 and the second reservoir 220 to filter impurities or ink clots from the ink being moved from the first reservoir 210 to the second reservoir 220. The filter 230 also operates to block bubbles of the ink from entering into the second reservoir 220. The filter 230 provides the ink with resistance when the ink moves from the first reservoir 210 to the second reservoir 220. Accordingly, to prevent the ink of the first reservoir 210 from entering into the second reservoir 220, the second reservoir 220 may have a negative pressure.

The ink tank 300 may be removably attached to the main body 100 as a removable ink tank, or securely fixed as a fixed ink tank. The removable ink tank 300 may include a cartridge type ink tank, and the fixed ink tank 300 may include a separate refillable ink cartridge.

The ink tank 300 may store ink to output a printing process, and may include an ink outlet 310 and an ink inlet 320. The ink outlet 310 may be connected to the ink inlet 211 of the first reservoir 210 via the ink supply path 410. The ink inlet 320 may be connected to a pump 500 via an ink introducing path 440. Accordingly, ink may be introduced through the ink inlet 320 and may circulate between the head assembly 200 and the ink tank 300.

A fluid port 330 may be provided at the upper part of the ink tank 300 as an air outlet to allow air to enter or exit from the fluid port 330. A valve may be provided to the fluid port 330.

An ink level sensor 340 may also be provided at the ink tank 300 to detect an amount of stored ink. The ink level sensor 340 may be connected to the controlling unit 700 to provide the controlling unit 700 with information regarding the amount of stored ink.

One end of the ink supply path 410 may be connected to the ink outlet 310 of the ink tank 300, while the other end may be connected to the ink inlet 211 of the first reservoir 210. The ink may be supplied from the ink tank 300 to the first reservoir 210 via the ink supply path 410, when the negative pressure is produced at the first feed line 420 or the second feed line 430.

One end of the first feed line 420 may be connected to the first ink outlet 212 of the first reservoir 210, while the other end may be connected to the pump 500. A valve unit 600 may be installed on the path between the other end of the first feed line 420 and the pump 500. The first feed line 420 may feed the ink of the first reservoir 210 directly to the ink tank 300. Because there is no significant fluid resistance, ink of the first reservoir 210 can be fast fed to the ink tank 300 via the first feed line 420. Ink in the ink tank 300 may be added to the first reservoir 210 when the ink of the first reservoir 210 has stayed in a non-use state for a long period of time, and the first feed line 420 is used to feed the ink from the first reservoir 210 to the ink tank 300. Any bubbles remaining in the first reservoir 210 may be returned to the ink tank 300 via the first feed line 420. The recovered bubbles may be subsequently discharged through the fluid port 330.

The second feed line 430 connects the second reservoir 220, that is, a downstream portion of the filter 230, to the ink tank 300. More specifically, a first end of the second feed line 430 is connected to the second ink outlet 222 of the second reservoir 220, a second other end is connected to the pump 500. A valve unit 600 may be provided between the second reservoir 220 and the pump 500. The ink downstream of the filter 230 may thus be recovered to the ink tank 300 via the second feed line 430. Accordingly, bubbles can be introduced to the ink tank 300 via the second feed line 430 if bubbles are stuck in the second reservoir 220 due to the filter 230. The second ink outlet 222 may be formed on the wall on which at least one of the ink inlet 211 and the first ink outlet 212.

The ink in the ink tank 300 may be supplied directly to the second reservoir 220 through the second feed line 430 without bypassing the first reservoir 210, according to the direction of a pump driving status and an operational status of the valve unit 600. By supplying the ink of the ink tank 300 directly to the second reservoir 220, a purging operation is enabled in which bubbles remaining in the second reservoir 220 and the nozzles of the head chip 240 are removed and the head chip 240 is primed with ink. Here, the ink contained in the first reservoir 210 may not be fed to the ink tank 300.

A sub filter 431 may be installed on the second feed line 430. The sub filter 431 filters the ink which is fed from the ink tank 300 to the second reservoir 220 via the second feed line 430 to perform the purging operation. The sub filter 431 may have a lower fluid resistance than the filter 430 inside the head assembly 200. Therefore, the ink from the ink tank 300 may pass through the sub filter 431 into the second reservoir 220, but will not pass through the filter 430 which has a greater resistance than the sub filter 431 and flow back to the first reservoir 210. Because the ink is discharged through the head chip 240 without having a backflow, the purging operation is possible.

The pump 500 may be rotatable in a bi-directional manner. Accordingly, the pump 500 may produce negative pressure at the head assembly 200 by being rotated in a direction A1, and may produce positive pressure by being rotated in a direction A2. If the negative pressure is generated, the ink of the ink tank 300 is introduced into the head assembly 200 via the supply path 410, and the ink of the head assembly 200 re-enters the ink tank 300 via the first feed line 420 and the second feed line 430. If the positive pressure is generated, the ink of the ink tank 300 is fed to the second reservoir 220 via the second feed line 430 by an operation of the valve unit 600. One end of the pump 500 may be connected to the ink inlet 320 of the ink tank 300, and the other end may be connected to the first feed line 420 and the second feed line 430 via the valve 600.

The valve unit 600 may include two-way valves 610 and 620 which are connected to the first feed line 420 and the second feed line 430, respectively. Accordingly, one two-way valve 610 may open or close the first feed line 420, and the other two-way valve 620 may open or close the second feed line 430.

The pump 500 and the valve unit 600 are independently controlled by the control unit 700.

The operation and effect of an inkjet recording apparatus constructed as explained above according to exemplary aspects of the present general inventive concept will be explained in greater detail below.

Ink circulation may be conducted mainly in three circulation modes as listed below, excluding the circulation modes during a power off state.

TABLE 1

| | Pump (500) | Valve 1 (620) | Valve 2 (610) |
|---|---|---|---|
| 1 | Negative pressure | Close | Open |
| 2 | Negative pressure | Open | Close |
| 3 | Positive pressure | Open | Close |
| 4 | Off | Close | Open |
| 5 | Off | Close | Open |

Figure 3:
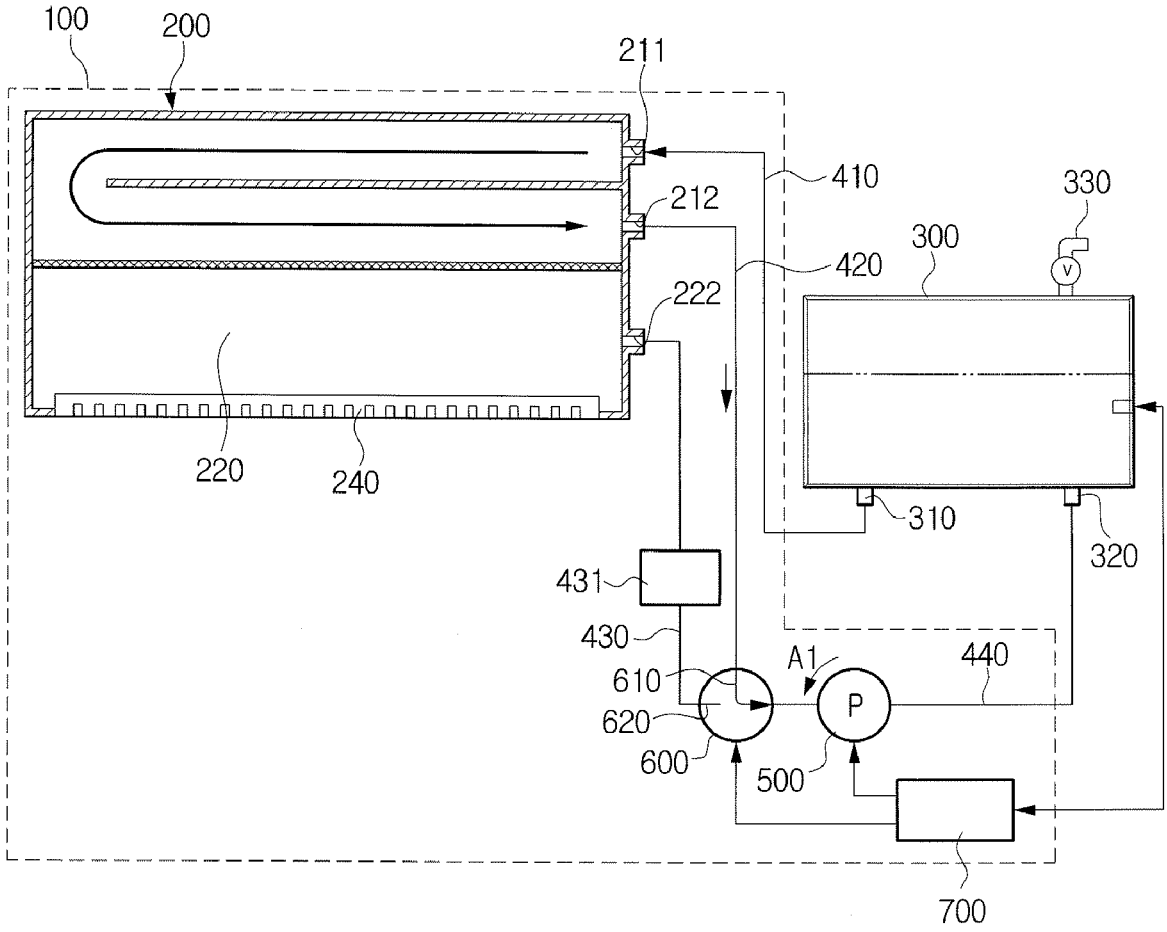
FIG. 3 illustrates a first circulation of the ink circulation system of FIG. 2.

Referring to FIGS. 2 and 3, in a first circulation mode, the pump 500 is driven in the direction A1. The first valve 620 is closed and the second valve 610 is open. As a result, a negative pressure is generated by the pump 500 and is applied to the first feed line 420. Due to the negative pressure exerted to the first feed line 420, the ink upstream of the filter 430, that is, the ink of the first reservoir 210 is passed via the first feed line 420, the valve 600 and the pump 500, and enters the ink tank 300. The ink of the ink tank 300 is supplied into the first reservoir 210 via the supply path 410. Because the flow of ink to the ink tank 300 does not meet any resistance of the filter 430, a smooth flow of ink may occur. Additionally, because negative pressure is not exerted to the second reservoir 220 and the head chip 240, the ink may circulate without breaking a meniscus of each of the nozzles. The first circulation mode is utilized when the ink within the head assembly 200 has not been used for a long period of time, and thus, the ink of the ink tank 300 may mix with the ink of the first reservoir 210, and move the ink to prevent ink hardening or uneven ink density. The first circulation mode is also useful when the bubbles of the first reservoir 210 increase due to long use. Accordingly, the bubbles of the first reservoir 210 may be forcibly moved to the ink tank 300.

Figure 4:
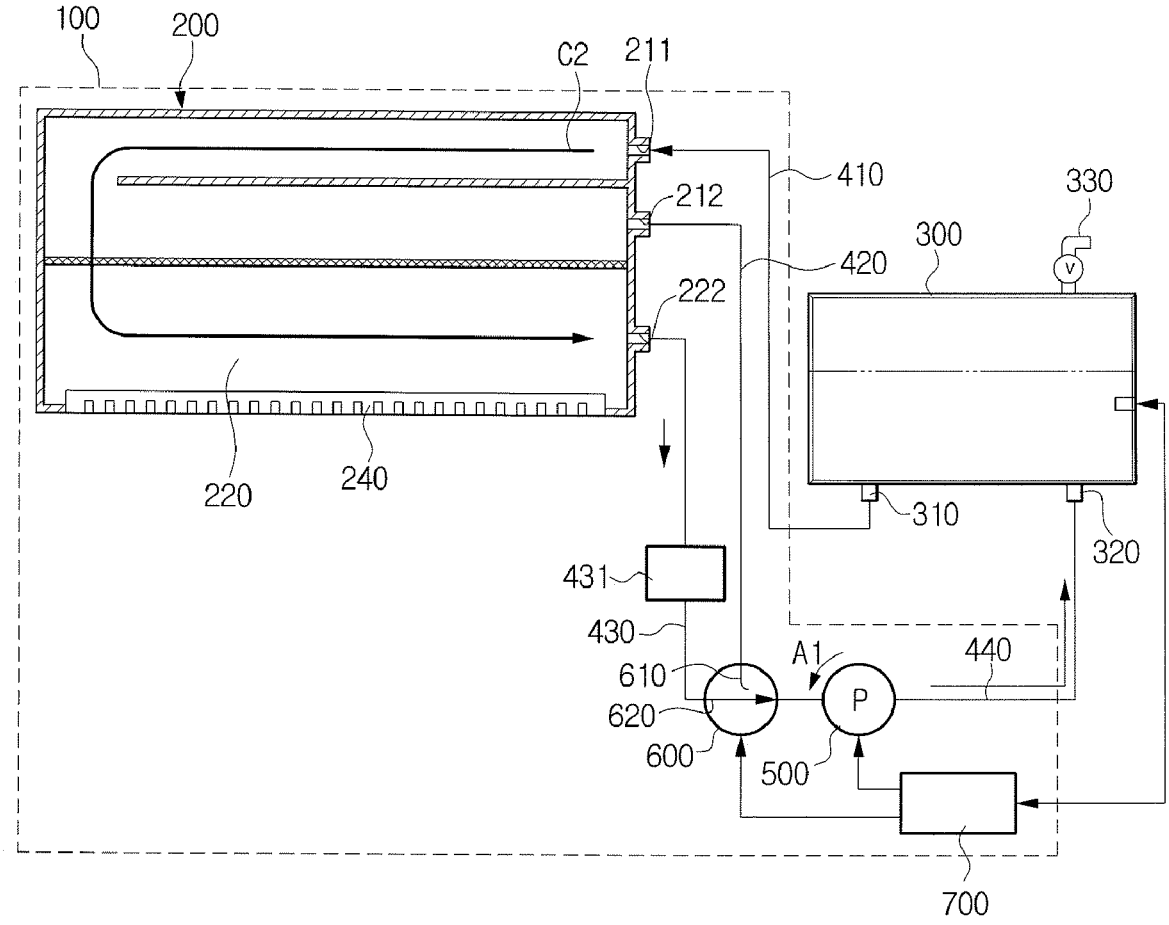
FIG. 4 illustrates a second circulation of the ink circulation system of FIG. 2.

Referring to FIGS. 2 and 4, in a second circulation mode, the pump 500 is driven in the direction A1 to generate negative pressure. The first valve 620 is open and the second valve 610 is closed. As a result, a negative pressure is exerted to the second reservoir 220 via the second feed line 430. According to the negative pressure, the ink of the second reservoir 220 may be passed via the second feed line 430, the valve 600, and the pump 500, and recovered into the ink tank 300. Because the first valve 610 is closed, negative pressure exerted through the first feed line 420 to the first reservoir 210 is not so big, but a small portion of the negative pressure is applied through the filter 430.

As the ink of the second reservoir 220 is moved into the ink tank 300, a considerable amount of bubbles stuck in the filter 230 at the second reservoir 220 may re-enter the ink tank 300. Also, when the negative pressure exerted to the second reservoir 220, the ink of the first reservoir 210 is moved to the second reservoir 220 via the filter 230, and the ink of the ink tank 300 is supplied to the first reservoir 210 via the supply path 410. In the second circulation mode, the bubbles generated by the printing operation which remain in the second reservoir 220 can re-enter the ink tank 300 to be removed from the second reservoir 220. As a result, efficient ink firing may be enabled in the following printing operation, such that image degradation can be prevented. The sub filter 431 on the second feed line 430 may have a lower fluid resistance than the filter 230 such that the ink is moved along the second feed line 430 due to the negative pressure, along with the bubbles. At this time, the bubbles of the recovered ink may pass through the sub filter 431 and re-enter the ink tank 300.

Figure 5:
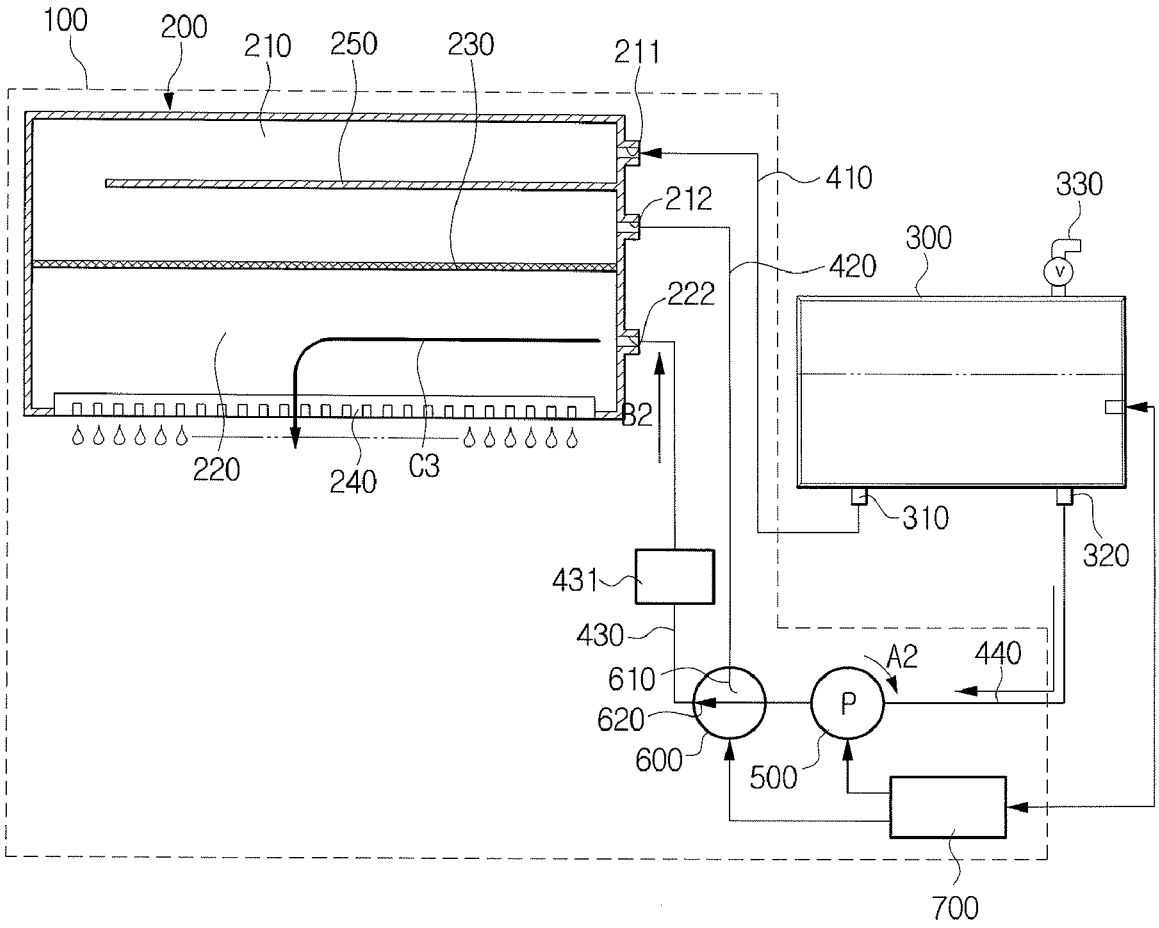
FIG. 5 illustrates a purging operation of the ink circulation system of FIG. 2.

The purging operation as mentioned above with reference to FIG. 2 will be explained in greater detail below, with reference to FIG. 5. The pump 500 is driven in the direction A2 to perform the purging operation. The second valve 610 is closed, and the first valve 620 is open. As a result, the pump 500 is driven in the direction A2 to generate positive pressure, and the generated positive pressure is exerted to the ink tank 300. Accordingly, the ink of the ink tank 300 is passed through the pump 500, the valve unit 600 and the sub filter 431, and is fed into the second reservoir 220. The ink of the second reservoir 220 is discharged out through the nozzles of the head chip 240. Because the sub filter 431 has a lower resistance than the filter 230, the ink is passed through the sub filter 431 by the positive pressure, but does not flow into the first reservoir 210 through the filter 230 while the ink is discharged through the head chip 240. Along with the ink discharged through the head chip 240, the bubbles at the nozzles are also removed, and the head chip 240 is charged with the ink. After the ink is discharged through the head chip 240, meniscus can be recovered by an appropriate recovery operation such as wiping or spitting.

When the pump 500 is stopped, the first valve 620 may be closed and the second valve 610 may be opened in the printing operation. Then by appropriately controlling the head chip 240, the ink may be fired to form an image.

The pump 500 may stop when the power is off. Accordingly, the first value 620 and the second valve 610 are closed.

An ink circulation system and an inkjet recording apparatus according to a plurality of exemplary embodiments of the present general inventive concept have been outlined. According to the exemplary embodiments of the present general inventive concept, the head assembly 200 is divided into a first reservoir 210 and a second reservoir 220 by a filter 230, and ink circulation is appropriately controlled between a first circulation mode in which the ink is replaced with new ink, and a second circulation mode in which negative pressure is produced at the second reservoir 220 and ink is circulated to remove bubbles accumulated at the filter 230.

Accordingly, a smooth ink circulation is enabled with a small driving load in the first circulation mode, while efficient removal of bubbles from the filter 230 is enabled in the second circulation mode.

Additionally, positive pressure may be generated in the paths associated with the second circulation mode, such that the ink of the ink tank 300 is supplied to the second reservoir 220, a head chip 240 is charged with the ink, and the bubbles are removed. As a result, the optimum condition to perform a printing operation is provided.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An ink circulation system, comprising:

an ink tank to store ink and comprising an ink outlet and an ink inlet;

a head assembly comprising a head chip through which the ink is discharged, and a filter;

a supply path to supply the ink of the ink tank to the head assembly;

a first feed line through which ink of the head assembly at an upstream of the filter is conveyed into the ink tank;

a second feed line through which the ink of the head assembly at a downstream of the filter is conveyed to the ink tank; and a pump which is provided at the ink inlet of the ink tank to provide the first and the second feed lines with a negative pressure to circulate the ink.

2. The ink circulation system of claim 1, wherein the head assembly comprises:

a first reservoir comprising an ink inlet and a first ink outlet; and a second reservoir which is partitioned from the first reservoir by the filter, comprising a second ink outlet.

3. The ink circulation system of claim 2, wherein the head chip is connected to the second reservoir to receive the ink such that the ink of the second reservoir is fired through the head chip.

4. The ink circulation system of claim 2, wherein the second reservoir is arranged at a lower portion of the first reservoir.

5. The ink circulation system of claim 2, wherein the first reservoir further comprises:

an ink guider to guide the ink in a manner such that a distance of ink conveyance between the ink inlet and the first ink outlet is extended.

6. The ink circulation system of claim 2, wherein the supply path connects the ink outlet of the ink tank to the ink inlet of the first reservoir.

7. The ink circulation system of claim 2, wherein the first feed line connects the first ink outlet to the pump.

8. The ink circulation system of claim 2, wherein the second feed line connects the second ink outlet to the pump.

9. The ink circulation system of claim 1, further comprising:

a valve unit to selectively transmit a pumping force of the pump to the first and the second feed lines.

10. The ink circulation system of claim 9, wherein the valve unit comprises:

two-way valves connected to the first and the second feed lines, respectively, and accordingly connected to the pump.

11. The ink circulation system of claim 1, further comprising:

a sub filter installed on the second feed line.

12. The ink circulation system of claim 11, wherein the sub filter has a lower resistance than the filter inside the head assembly.

13. The ink circulation system of claim 1, wherein the pump comprises a uni-directional rotational pump to generate a negative pressure to the first and the second feed lines.

14. The ink circulation system of claim 1, wherein the pump comprises a bi-directional rotational pump to selectively provide the second feed line with the negative pressure or a positive pressure according to the direction in which the pump is driven.

15. An inkjet recording apparatus, comprising:

a main body;

an ink circulation system comprising:

an ink tank to store ink comprising an ink outlet and an ink inlet, a head assembly comprising a head chip through which the ink is discharged, and a filter, a supply path to supply the ink of the ink tank to the head assembly, a first feed line through which ink of the head assembly at an upstream of the filter is conveyed into the ink tank, a second feed line through which the ink of the head assembly at a downstream of the filter is conveyed to the ink tank, and a pump which is provided at the ink inlet of the ink tank to provide the first and the second feed lines with a negative pressure to circulate the ink; and a control unit to selectively control the pump such that the ink is forcibly circulated through the first or the second feed line.

16. The inkjet recording apparatus of claim 15, further comprising:

a valve unit installed between the first feed line and the pump and between the second feed line and the pump, respectively, to be selectively opened or closed and thus to open one of the first and the second feed line according to the control of the control unit.

17. The inkjet recording apparatus of claim 16, wherein the valve unit comprises:

two-way valves connected to the first and the second feed lines and the pump.

18. The inkjet recording apparatus of claim 15, wherein the head assembly comprises:

a first reservoir which comprising an ink inlet, and a first ink outlet; and a second reservoir which is partitioned from the first reservoir by the filter, comprising a second ink outlet.

19. The inkjet recording apparatus of claim 18, wherein the second reservoir is arranged at a lower portion of the first reservoir.

20. The inkjet recording apparatus of claim 18, wherein the head chip is housed in the second reservoir in a fluid communication.

21. The inkjet recording apparatus of claim 15, wherein the ink circulation system comprises a sub filter installed on the second feed line.

22. The inkjet recording apparatus of claim 21, wherein the sub filter has a lower resistance than the filter inside the head assembly.

23. The inkjet recording apparatus of claim 21, wherein the pump includes a bi-directional rotational pump to provide the first and the second feed lines with the negative pressure, or to provide the second feed line with a positive pressure according to the direction in which the pump is driven.

24. An ink circulation system, comprising:

a head assembly having a filter to partition an inside space into a first reservoir and a second reservoir;

an ink inlet to supply ink to the first reservoir;

a first ink outlet to discharge the ink from the first reservoir;

an ink guider disposed in the first reservoir between the ink inlet and the first ink outlet;

a second ink outlet disposed in the second reservoir to supply and discharge the ink to and from the second reservoir; and a head chip disposed opposite on the head assembly to the filter with respect to the second reservoir to eject the ink.

25. The ink circulation system of claim 24, further comprising:

an ink tank having an ink outlet to be connected to the ink inlet of the head assembly, and an ink inlet to be connected to one of the first ink inlet of the first reservoir and the second inlet of the second reservoir.

26. The ink circulation system of claim 25, further comprising:

a pump to selectively generate a negative pressure and a positive pressure; and a valve to connect the pump to one of the first ink outlet and the second ink outlet to selectively apply the negative pressure and the positive pressure to one of the first ink outlet and the second ink outlet.

27. The ink circulation system of claim 26, further comprising:

a control unit to control the pump and the valve to selectively provide the negative pressure to at least one of the first ink outlet to selectively provide the positive pressure to the second ink outlet.

28. The ink circulation system of claim 24, further comprising:

an ink tank connectable to the head assembly to supply ink to the head assembly and receive the ink from the head assembly; and a valve disposed between the head assembly and the ink tank to provide a first circulation mode in which the ink is circulated between the head assembly and the ink tank, the ink being circulated at an upstream of the filter, a second circulation mode in which bubbles are removed from a downstream of the filter by circulating the ink between the head assembly and the ink tank, and a third circulation mode in which the bubbles at a plurality of nozzles are also removed, and the head chip is charged with the ink.

* * * * *